US010981695B2

(12) United States Patent
Jiang

(10) Patent No.: US 10,981,695 B2
(45) Date of Patent: Apr. 20, 2021

(54) PALLET STRUCTURE WITH AIR BAG STRUCTURE, CABINET DEVICE WITH PALLET STRUCTURE, AND METHOD THEREOF

(71) Applicant: Wistron Corporation, New Taipei (TW)

(72) Inventor: Jheng-Ying Jiang, New Taipei (TW)

(73) Assignee: Wiwynn Corporation, New Taipei (TW)

( * ) Notice: Subject to any disclaimer, the term of this patent is extended or adjusted under 35 U.S.C. 154(b) by 747 days.

(21) Appl. No.: 15/468,095

(22) Filed: Mar. 23, 2017

(65) Prior Publication Data

US 2018/0111717 A1 Apr. 26, 2018

(30) Foreign Application Priority Data

Oct. 26, 2016 (TW) ..... 105134514

(51) Int. Cl.
*B65D 19/40* (2006.01)
*B65D 19/44* (2006.01)
(Continued)

(52) U.S. Cl.
CPC ..... *B65D 19/40* (2013.01); *A47B 91/005* (2013.01); *A47B 91/06* (2013.01); *B65D 19/0012* (2013.01); *B65D 19/44* (2013.01); *B65D 81/022* (2013.01); *B65D 2519/0086* (2013.01); *B65D 2519/00273* (2013.01); *B65D 2519/00293* (2013.01); *B65D 2519/00323* (2013.01); *B65D 2519/00761* (2013.01);
(Continued)

(58) Field of Classification Search
CPC .... B65D 19/40; B65D 19/44; B65D 19/0012; B65D 81/022; A47B 91/005; A47B 91/06
USPC ..... 254/93 HP, 93 R
See application file for complete search history.

(56) References Cited

U.S. PATENT DOCUMENTS 5,826,893 A * 10/1998 Snoeyenbos ..... B62B 5/0083 280/43
6,095,533 A * 8/2000 Balolia ..... B60T 1/14 188/19
(Continued)

FOREIGN PATENT DOCUMENTS

CN 2451493 Y 10/2001
CN 2568550 Y 8/2003
(Continued)

OTHER PUBLICATIONS

Office action dated Feb. 16, 2017 for Taiwan application No. 105134514, filing date Oct. 26, 2016, p. 1 line 13-14, p. 2-5 and p. 6 line 1-12.

*Primary Examiner* — Lee D Wilson
*Assistant Examiner* — Seahee Hong
(74) *Attorney, Agent, or Firm* — Winston Hsu

(57) ABSTRACT

A pallet structure includes at least one bottom plate and at least one air bag. The at least one bottom plate is disposed on a bottom side of the cabinet for supporting the cabinet. The at least one air bag is detachably installed on a bottom side of the at least one bottom plate. The at least one air bag is inflated to prop the at least one bottom plate against the cabinet upwardly until at least one supporting component of the cabinet leaves away from a supporting surface, so as to effectively absorb a shock load during transportation of the cabinet.

4 Claims, 10 Drawing Sheets

(51) Int. Cl.

| | |
|---|---|
| ***B65D 81/02*** | (2006.01) |
| ***B65D 19/00*** | (2006.01) |
| ***A47B 91/00*** | (2006.01) |
| ***A47B 91/06*** | (2006.01) |

(52) U.S. Cl.
CPC ..... *B65D 2519/00781* (2013.01); *B65D 2519/00786* (2013.01); *B65D 2519/00815* (2013.01); *B65D 2585/647* (2013.01)

(56) References Cited

U.S. PATENT DOCUMENTS

| | | | | |
|---|---|---|---|---|
| 7,059,617 | B1 * | 6/2006 | Verna | B62B 5/0083 280/79.3 |
| 2009/0279998 | A1 | 11/2009 | Fukuda | |
| 2010/0212982 | A1 | 8/2010 | Lin | |
| 2018/0127147 | A1 * | 5/2018 | Embleton | B65D 81/02 |

FOREIGN PATENT DOCUMENTS

| | | | |
|---|---|---|---|
| CN | 200997727 | Y | 12/2007 |
| CN | 201120980 | Y | 9/2008 |
| CN | 101287625 | A | 10/2008 |
| CN | 202598058 | U | 12/2012 |
| CN | 103395572 | A | 11/2013 |
| TW | I353325 | B1 | 12/2011 |

* cited by examiner

PALLET STRUCTURE WITH AIR BAG STRUCTURE, CABINET DEVICE WITH PALLET STRUCTURE, AND METHOD THEREOF

BACKGROUND OF THE INVENTION

1. Field of the Invention

The present disclosure relates to a pallet structure and a cabinet device, and more particularly, to a pallet structure with air bag structure, which is capable of effectively absorbing a shock load during transportation of a cabinet, a cabinet device therewith, and a method thereof.

2. Description of the Prior Art

Transportation of a batch of cabinets by a container at one time can effectively reduce transportation cost. However, the cabinets may be damaged easily because of shock loads during transportation. Therefore, the current solution is to dispose a high density foam component between a pallet and a cabinet for absorbing shock loads during transportation of the cabinet, which prevents damage of a server in the cabinet. However, in order to unload the cabinet from the container to a predetermined location, it normally requires a manual forklift, a forklift truck, and a slope. The manual forklift is utilized to move the pallet and the cabinet together to an outlet of the container. The forklift truck unloads the pallet and the cabinet together from the container. The cabinet slides along the slope to depart from the pallet. In other words, when a worker cannot prepare the manual forklift, the forklift truck and the slope in time, it is difficult for the worker to unload the cabinet from the container to the predetermined location. Furthermore, since weight of the fully loaded cabinet is approximately 1000 kilograms, the high density foam component usually cannot be reused after being pressed. Replacement of such shock-absorbing consumable increases transportation cost.

SUMMARY OF THE INVENTION

Therefore, it is an objective of the present disclosure to provide a pallet structure with air bag structure, a cabinet device therewith, and a method thereof.

In order to achieve the aforementioned objective, the present disclosure discloses a pallet structure for transporting a cabinet. The pallet structure includes at least one bottom plate and at least one airbag. The at least one bottom plate is for supporting the cabinet. The at least one air bag is detachably installed on the at least one bottom plate. When the at least one air bag is inflated, the at least one air bag props the at least one bottom plate against the cabinet upwardly, so as to enable at least one supporting component of the cabinet to leave away from a supporting surface.

According to an embodiment of the present disclosure, the pallet structure includes a plurality of airbags and further includes an inflating pipe assembly connected between the plurality of air bags and for inflating the plurality of air bags at the same time.

According to an embodiment of the present disclosure, the pallet structure further includes at least one lateral plate fixed on the at least one bottom plate and abutting against at least one lateral side of the cabinet.

According to an embodiment of the present disclosure, the pallet structure includes a plurality of lateral plates and further includes a plurality of adjusting modules, and each of the plurality of adjusting modules includes two rods slidably disposed on the corresponding lateral plate.

According to an embodiment of the present disclosure, each of the plurality of adjusting modules further includes a connecting component slidably connected between the two rods disposed on the two adjacent lateral plates.

According to an embodiment of the present disclosure, each of the plurality of adjusting modules further includes a plurality of fixing components. A sliding slot is formed on each of the plurality of rods. An adjusting slot is formed on each of two ends of each of the plurality of connecting components. At least one of the plurality of fixing components passes through the corresponding sliding slot to be fixed onto the corresponding lateral plate for restraining a relative movement between the corresponding rod and the corresponding lateral plate, and at least another one of the plurality of fixing components passes through the corresponding sliding slot and the corresponding adjusting slot to be fixed onto the corresponding connecting component for restraining a relative movement between the corresponding rod and the corresponding connecting component.

According to an embodiment of the present disclosure, each of the plurality of connecting components is substantially formed in an L-shape.

According to an embodiment of the present disclosure, the pallet structure further includes a plurality of ball bearing slides, and each of the plurality of ball bearing slides is disposed between the corresponding rod and the corresponding lateral plate.

According to an embodiment of the present disclosure, the at least one supporting component contacts the supporting surface when the at least one air bag is deflated.

According to an embodiment of the present disclosure, the pallet structure further includes at least one packing strap. A plurality of recesses is formed on the at least one bottom plate, and the at least one packing strap wraps the cabinet and passes through the plurality of recesses to fix the cabinet onto the at least one bottom plate.

In order to achieve the aforementioned objective, the present disclosure further discloses a cabinet device including a cabinet and a pallet structure. The cabinet includes a bottom side, at least one lateral side, and at least one supporting component disposed on the bottom side. The pallet structure includes at least one bottom plate and at least one air bag. The at least one bottom plate is for supporting the cabinet. The at least one air bag is detachably installed on the at least one bottom plate. When the at least one air bag is inflated, the at least one air bag props the at least one bottom plate against the cabinet upwardly, so as to enable at least one supporting component to leave away from a supporting surface.

According to an embodiment of the present disclosure, the at least one supporting component is a wheel or a post.

In order to achieve the aforementioned objective, the present disclosure further discloses a method of utilizing a pallet structure for transporting a cabinet. The method includes disposing at least one bottom plate of the pallet structure on a bottom side of the cabinet for supporting the cabinet, inflating at least one air bag of the pallet structure to prop the at least one bottom plate against the cabinet upwardly until at least one supporting component of the cabinet leaves away from a supporting surface for absorbing a shock load during transportation of the cabinet, and deflating the at least one air bag of the pallet structure to lower the at least one bottom plate until the at least one supporting component contacts the supporting surface.

According to an embodiment of the present disclosure, the method further includes disposing at least one lateral plate to abut against at least one lateral side of the cabinet.

According to an embodiment of the present disclosure, the method further includes inflating the at least one air bag of the pallet structure after loading the cabinet into a container.

According to an embodiment of the present disclosure, the method further includes unloading the cabinet from the container after deflating the at least one air bag of the pallet structure.

In summary, the present disclosure utilizes the air bag for propping the cabinet upwardly until the supporting component leaves away from the supporting surface when the air bag is inflated. Therefore, the inflated air bag can absorb the shock load during transportation of the cabinet. On the other hand, when the air bag is deflated, the bottom plate can be driven to be lowered until the supporting component contacts the supporting surface. Therefore, the cabinet can be moved to a predetermined location by wheels easily. Therefore, the pallet structure of the present disclosure has advantages of simple structure and easy operation. Furthermore, all components of the pallet structure can be reused. For example, the air bag, which is used for absorbing the shock load, can be inflated and deflated repeatedly. It solves the problem of replacing shock-absorbing consumables, such as a conventional high density foam component, and reduces transportation cost.

These and other objectives of the present disclosure will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the disclosure may be practiced. In this regard, directional terminology, such as "top," "bottom," "front," "back," etc., is used with reference to the orientation of the Figure(s) being described. The components of the present disclosure can be positioned in a number of different orientations. As such, the directional terminology is used for purposes of illustration and is in no way limiting. Accordingly, the drawings and descriptions will be regarded as illustrative in nature and not as restrictive.

Figure 1:
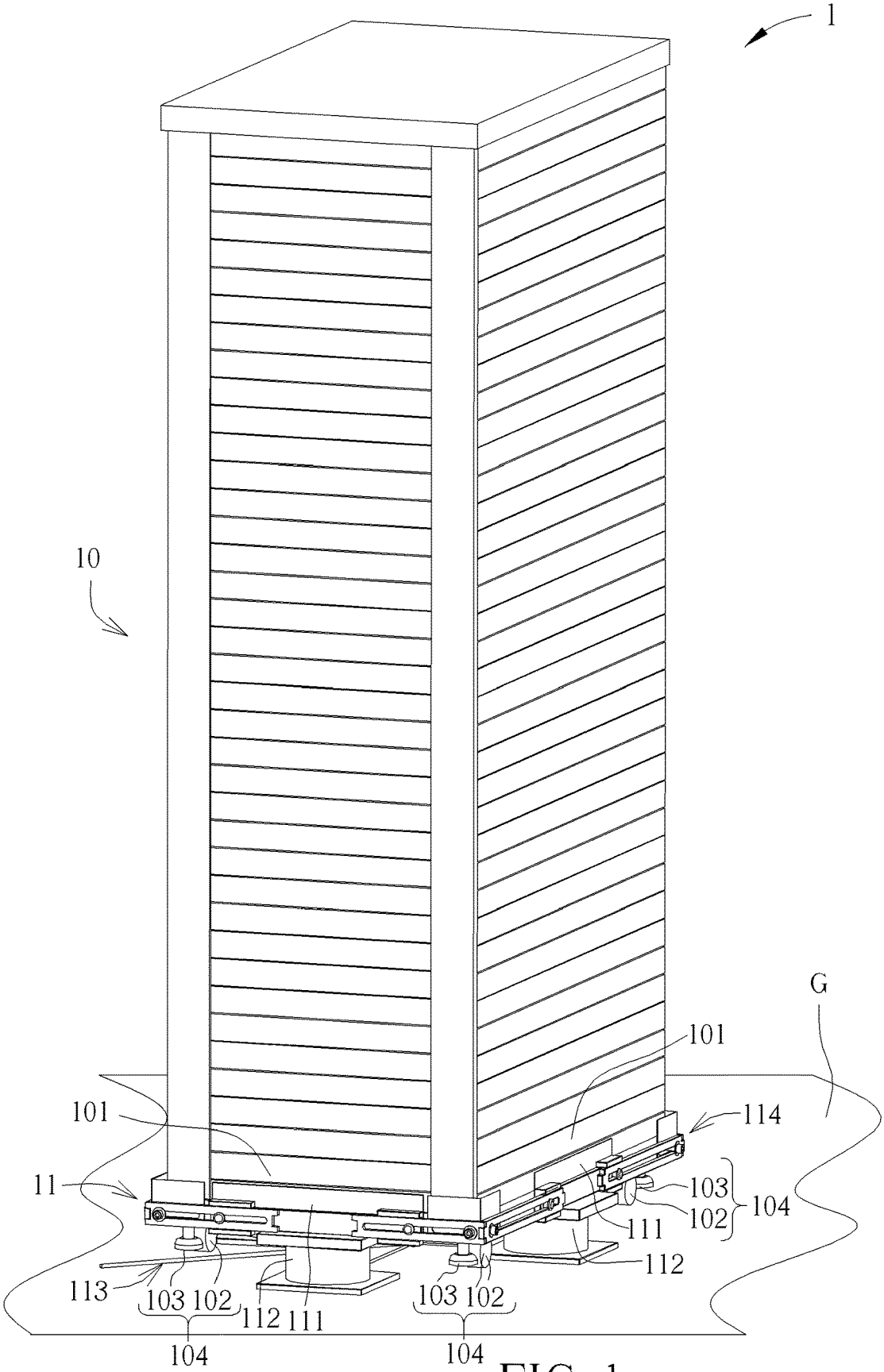
FIG. 1 is a schematic diagram of a cabinet device according to a first embodiment of the present disclosure.
Figure 2:
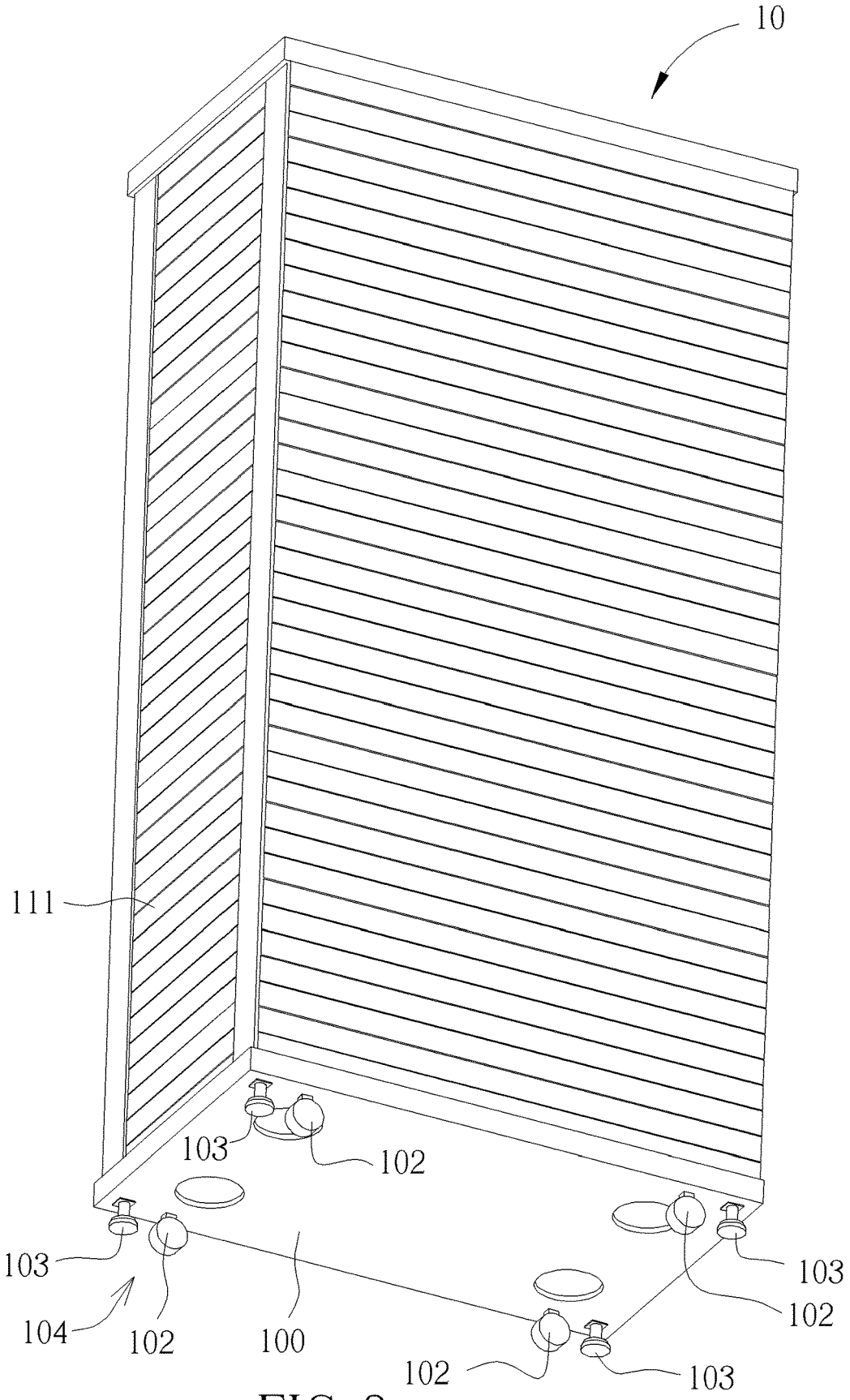
FIG. 2 is a diagram of a cabinet according to the first embodiment of the present disclosure.

Please refer to FIG. 1 and FIG. 2. FIG. 1 is a schematic diagram of a cabinet device 1 according to a first embodiment of the present disclosure. FIG. 2 is a diagram of a cabinet 10 according to the first embodiment of the present disclosure. As shown in FIG. 1 and FIG. 2, the cabinet device 1 includes the cabinet 10 and a pallet structure 11. The cabinet 10 can be a server cabinet receiving a server. The cabinet 10 includes a bottom side 100, four lateral sides 101 and eight supporting components 104 disposed on the bottom side 100. In this embodiment, the eight supporting components 104 can be four wheels 102 and four posts 103. The four wheels 102 are rotatably installed on the bottom side 100. The four posts 103 are retractably installed on the bottom side 100. When the four posts 103 are operated to extend to abut against a supporting surface G for driving the four wheels 102 to separate from the supporting surface G, the cabinet device 1 cannot move relative to the supporting surface G, which facilitates workers to fix the cabinet 10 at a fixed position. When the four posts 103 are operated to retract to drive the four wheels 102 to contact the supporting surface G, the cabinet device 1 can be moved relative to the supporting surface G by the four wheels 102 easily. However, the supporting component 104 of the present disclosure is not limited thereto. For example, in another embodiment, the cabinet 10 also can include either one of the wheels 102 and the posts 103.

Figure 3:
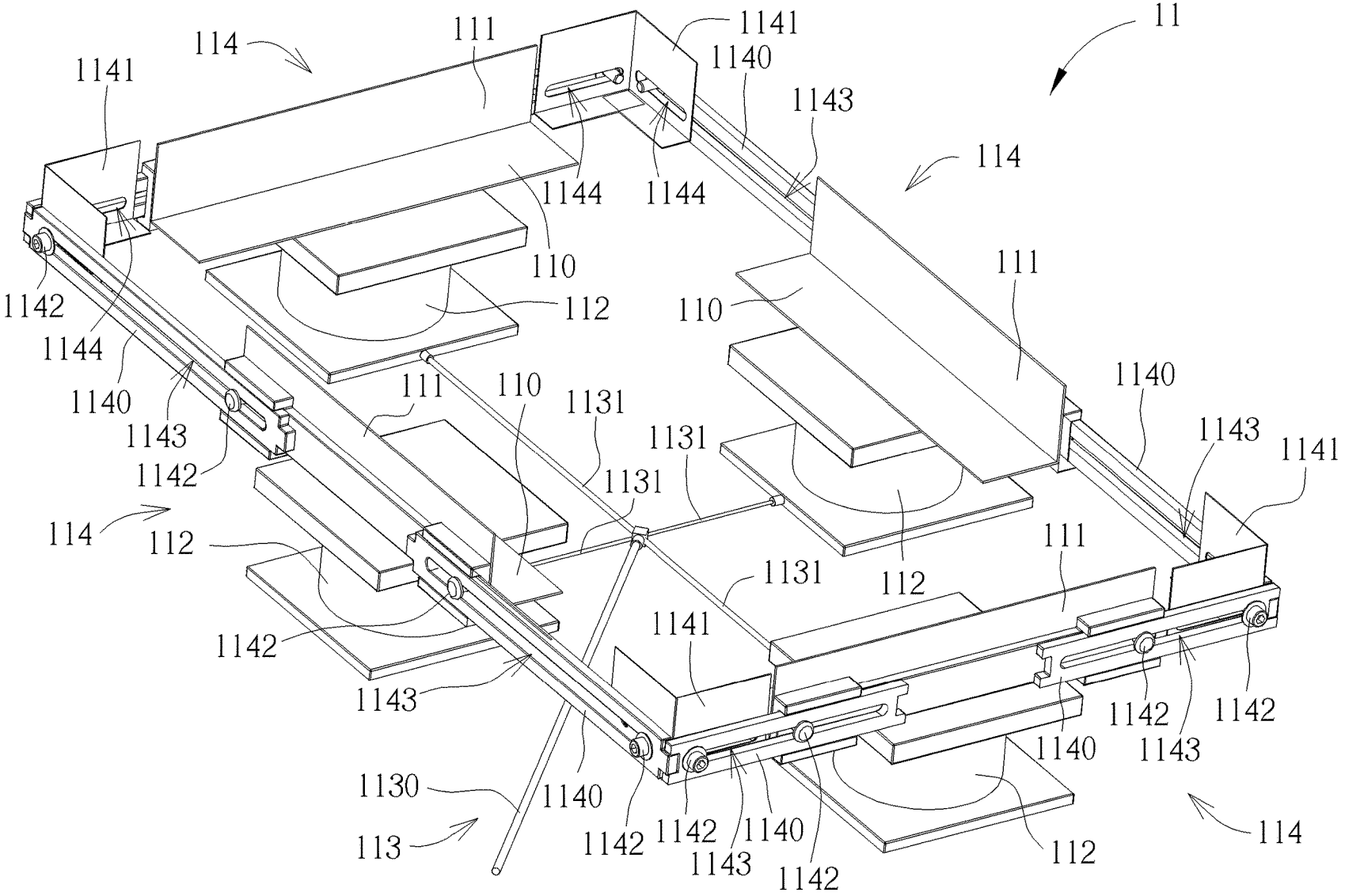
FIG. 3 is a diagram of a pallet structure according to the first embodiment of the present disclosure.

Please refer to FIG. 1 and FIG. 3. FIG. 3 is a diagram of the pallet structure 11 according to the first embodiment of the present disclosure. The pallet structure 11 includes four bottom plates 110, four lateral plates 111, four air bags 112, an inflating pipe assembly 113, and four adjusting modules 114. The four bottom plates 110 are disposed on the bottom side 100 of the cabinet 10 for supporting the cabinet 10. Each of the four lateral plates 111 is fixed on the corresponding bottom plate 110 and abuts against the corresponding lateral side 101 of the cabinet 10. Each of the four air bags 112 is detachably installed on a bottom portion of the corresponding bottom plate 110. The inflating pipe assembly 113 is connected among the four air bags 112 and for inflating the four air bags 112 simultaneously. In this embodiment, the inflating pipe assembly 113 of the present disclosure includes a main intake pipe 1130 and four branch intake pipes 1131. The main intake pipe 1130 is connected to an intake source, which is not shown in figures, and each of the four branch intake pipes 1131 is connected between the main intake pipe 1130 and the corresponding air bag 112, which achieves a purpose of inflating and deflating the four air bags 112 simultaneously. Furthermore, in this embodiment, the four branch intake pipes 1131 preferably have different diameters according to lengths of routes of the four branch intake pipes 1131 for inflating the four air bags 112 at the uniform speed, which can lift the cabinet 10 evenly and stably and prevent a risk of falling of the cabinet 10 due to uneven inflating speeds of the four air bags 112. For example, in this embodiment, as shown in FIG. 3, two of the four branch intake pipes 1131 with longer routes have diameters larger than diameters of the other two of the four branch intake pipes 1131 with shorter routes. However, the present disclosure is not limited thereto. In another embodiment, each of the four air bags 112 can be inflated and deflated separately by four independent intake pipes. It depends on practical demands.

Figure 4:
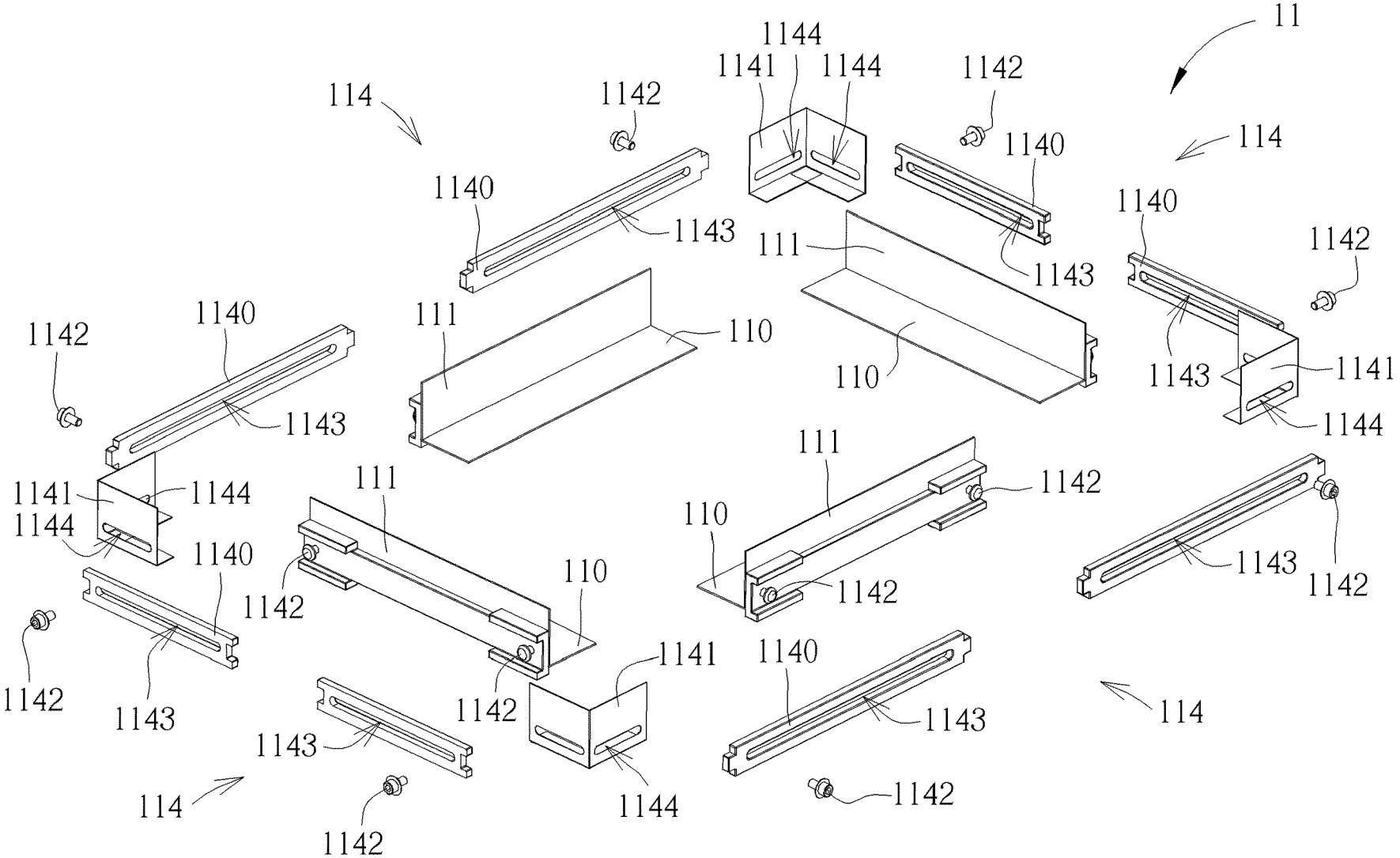
FIG. 4 is a partial exploded diagram of the pallet structure according to the first embodiment of the present disclosure.

Please refer to FIG. 3 and FIG. 4. FIG. 4 is a partial exploded diagram of the pallet structure 11 according to the first embodiment of the present disclosure. As shown in FIG. 3 and FIG. 4, each of the four adjusting modules 114 includes two rods 1140, a connecting component 1141 and four fixing components 1142. The two rods 1140 are slidably disposed on the corresponding lateral plate 111. The connecting component 1141 is slidably connected between the two rods 1140 disposed on the two adjacent lateral plates 111. In this embodiment, the four connecting components 1141 are respectively disposed at four corners of the cabinet 10 and substantially formed in an L-shape. Two vertical walls of each of the four connecting components 1141 are connected to the two adjacent rods 1140, respectively. In such a way, by adjusting relative positions of the rods 1140 and the corresponding lateral plates 111 and relative positions of the rods 1140 and the corresponding connecting components 1141 according to a size of the cabinet 10, the four bottom plates 110 and four lateral plates 111 of the pallet structure 11 can abut against the bottom side 100 and four lateral sides 101 of the cabinet 10, respectively, which achieves a purpose of supporting the cabinet 10 and restraining a horizontal displacement of the cabinet 10.

Figure 5:
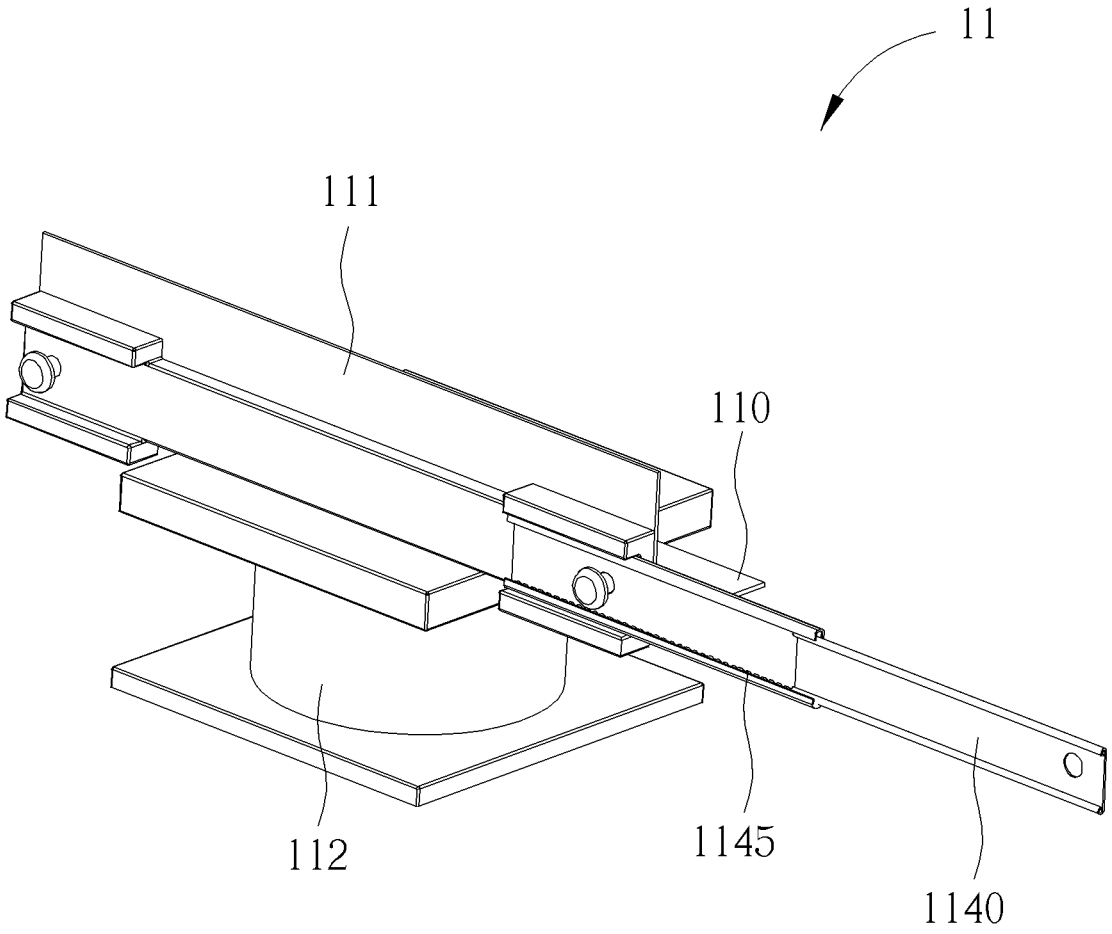
FIG. 5 is a partial diagram of a pallet structure according to another embodiment of the present disclosure.

Specifically, in this embodiment, a sliding slot 1143 is formed on each of the two rods 1140 of each adjusting module 114. An adjusting slot 1144 is formed on each of two ends of each connecting component 1141 of each adjusting module 114. Two of the four fixing components 1142 of each adjusting module 114 pass through the corresponding sliding slots 1143 to be fixed onto the corresponding lateral plate 111 for restraining relative movements between the corresponding rods 1140 and the corresponding lateral plate 111. The other two of the four fixing components 1142 of each adjusting module 114 pass through the corresponding sliding slots 1143 and the corresponding adjusting slots 1144 to be fixed onto the corresponding connecting components 1141 for restraining relative movements between the corresponding rods 1140 and the corresponding connecting components 1141. However, structure of the rod 1140 and the lateral plate 111 is not limited to those illustrated in figures of this embodiment. For example, please refer to FIG. 5. FIG. 5 is a partial diagram of the pallet structure 11 according to another embodiment of the present disclosure. As shown in FIG. 5, the rod 1140 also can be slidably disposed on the corresponding lateral plate 111 by a ball bearing slide 1145, which achieves a purpose of adjusting a relative position of the rod 1140 and the corresponding lateral plate 111.

Figure 6:
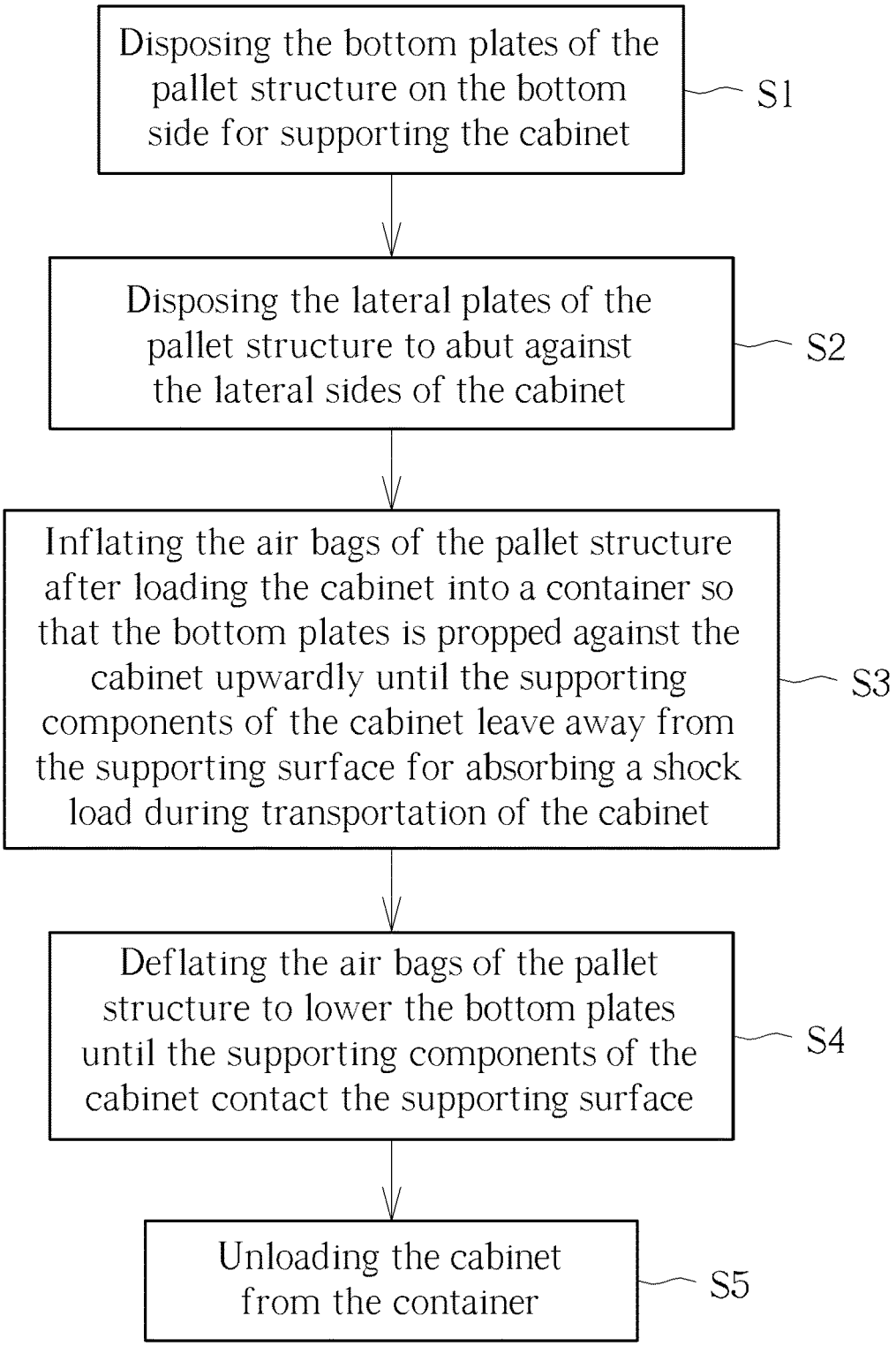
FIG. 6 is a flowchart of a method of utilizing the pallet structure for transporting the cabinet according to the first embodiment of the present disclosure.

Please refer to FIG. 6. FIG. 6 is a flowchart of a method of utilizing the pallet structure 11 for transporting the cabinet 10 according to the first embodiment of the present disclosure. As shown in FIG. 6, the method includes the following steps:

S1: disposing the bottom plates 110 of the pallet structure 11 on the bottom side 100 for supporting the cabinet 10;

S2: disposing the lateral plates 111 of the pallet structure 11 to abut against the lateral sides 101 of the cabinet 10;

S3: inflating the air bags 112 of the pallet structure 11 after loading the cabinet 10 into a container, which is not shown in figures, so that the bottom plates 110 is propped against the cabinet 10 upwardly until the supporting components 104 of the cabinet 10 leave away from the supporting surface G for absorbing a shock load during transportation of the cabinet 10;

S4: deflating the air bags 112 of the pallet structure 11 to lower the bottom plates 110 until the supporting components 104 of the cabinet 10 contact the supporting surface G; and S5: unloading the cabinet 10 from the container.

Figure 7:
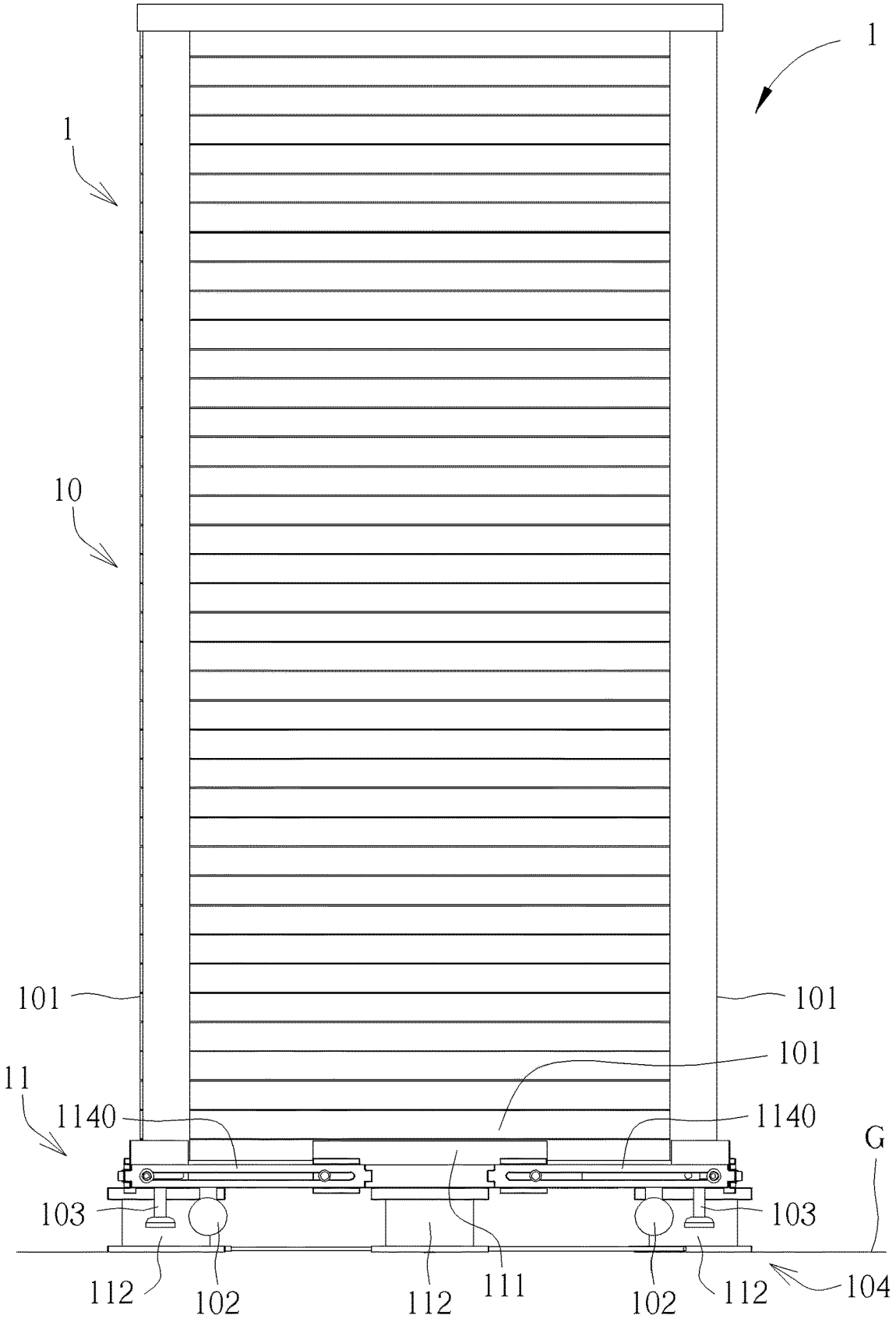
FIG. 7 is a diagram of the cabinet device at an inflating status according to the first embodiment of the present disclosure.
Figure 8:
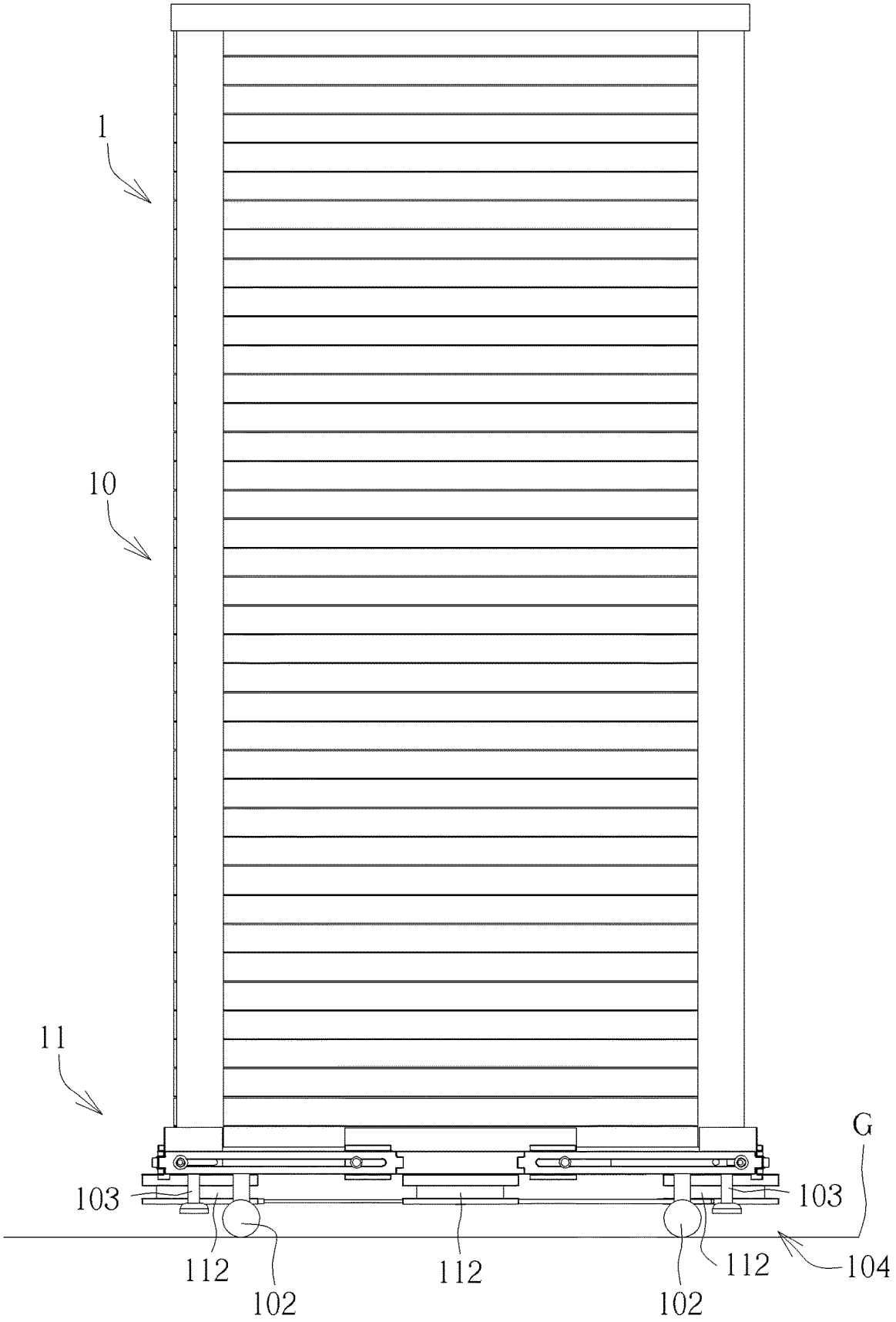
FIG. 8 is a diagram of the cabinet device at a deflating status according to the first embodiment of the present disclosure.

More detailed description for the steps of the method is provided as follows. Please refer to FIG. 1 to FIG. 8. FIG. 7 is a diagram of the cabinet device 1 at an inflating status according to the first embodiment of the present disclosure. FIG. 8 is a diagram of the cabinet device 1 at a deflating status according to the first embodiment of the present disclosure. In the steps 1 and 2, the four bottom plates 110 of the pallet structure 11 are installed on the bottom side 100 of the cabinet 10, and the four lateral plates 111 are installed to abut against the four lateral sides 101 of the cabinet by adjusting relative positions of the rods 1140 and the corresponding lateral plates 111 and relative positions of the rods 1140 and the corresponding connecting components 1141, which completes assembly of the pallet structure 11 and the cabinet 10. It should be noticed that it is not necessary to inflate the air bags 112 before the cabinet device 1 is loaded into the container, so that the wheels 102 of the cabinet 10 can contact a ground surface, which facilitates the worker to move the cabinet 10 easily. However, the present disclosure is not limited to this embodiment. The pallet structure 11 also can be assembled with the cabinet 10 after the cabinet 10 is loaded into the container. Afterwards, in the step 3, when the cabinet device 1 is loaded into the container, the air bags 112 of the pallet structure 11 can be inflated to prop the bottom plates 110 against the cabinet 10 upwardly until the supporting components 104 of the cabinet 10 leave away from the supporting surface G of the container. That is, all of the wheels 102 and the posts 103 of the cabinet 10 are driven to move upwardly to separate from the supporting surface G. At this moment, the cabinet device 1 is located at the inflating status as shown in FIG. 7. When the container is driven by a truck to cross over uneven grounds, the shock load can be absorbed by the air bags 112 and will not be transmitted to the cabinet 10 because the cabinet 10 does not contact the supporting surface G directly. It effectively prevents damage of the cabinet 10 caused by the shock load.

In the step 4, when the truck arrives at a destination, the air bags 112 can be deflated to lower the bottom plates 110 until the posts 103 contact the supporting surface G of the container. The lengths of the posts 103 can be adjusted to retract, so that the wheels 102 contact the supporting surface G. At this moment, the cabinet device 1 is located at the deflating status as shown in FIG. 8. The cabinet device 1 can be pushed to an outlet of the container by the wheels 102, unloaded from the container by a lifting tailgate of the container, and pushed to a predetermined location easily.

Figure 9:
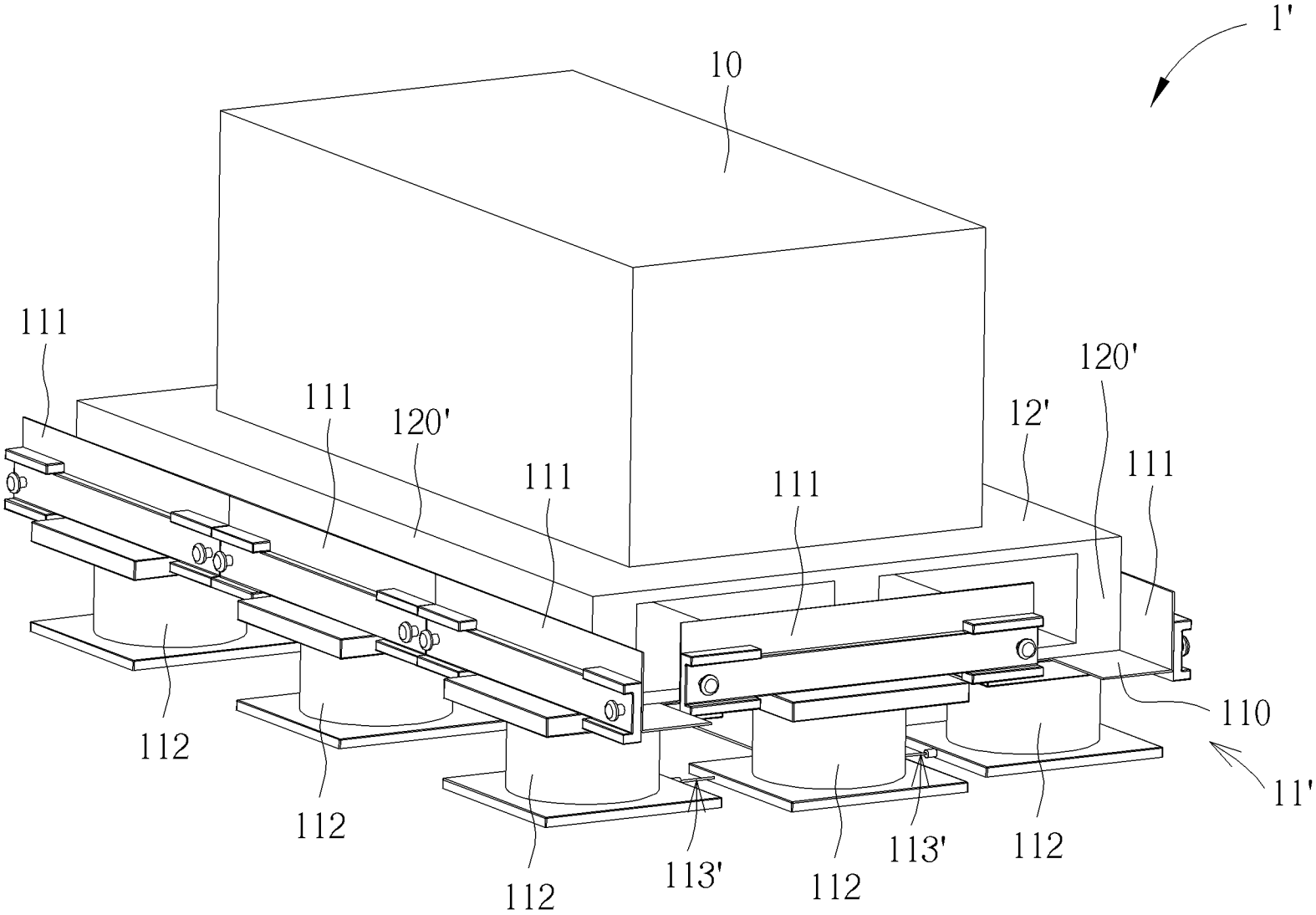
FIG. 9 is a partial schematic diagram of a cabinet device according to a second embodiment of the present disclosure.

Please refer to FIG. 9. FIG. 9 is a partial schematic diagram of a cabinet device 1' according to a second embodiment of the present disclosure. As shown in FIG. 9, the difference between the cabinet device 1' of the second embodiment and the cabinet device 1 of the first embodiment is described as follows. The cabinet device 1' includes the cabinet 10, a pallet structure 11' and a supporting plate 12'. In this embodiment, the supporting plate 12' can be a wooden pallet. The cabinet 10 is horizontally placed on the supporting plate 12'. The supporting plate 12' is disposed on the pallet structure 11'. The pallet structure 11' includes eight bottom plates 110, eight lateral plates 111, eight air bags 112, and an inflating pipe assembly 113' but does not include the aforementioned adjusting module. That is, relative positions of the bottom plates 110 and the lateral plates 111 are fixed. In this embodiment, the eight bottom plates 110 can be arranged according to weight and a center of gravity of the cabinet 10 and the supporting plate 12'. Each of the eight lateral plates 111 abuts against a corresponding lateral side 120' of the supporting plate 12'. The inflating pipe assembly 113' is connected among the eight air bags 112 for inflating the eight air bags 112 simultaneously.

Figure 10:
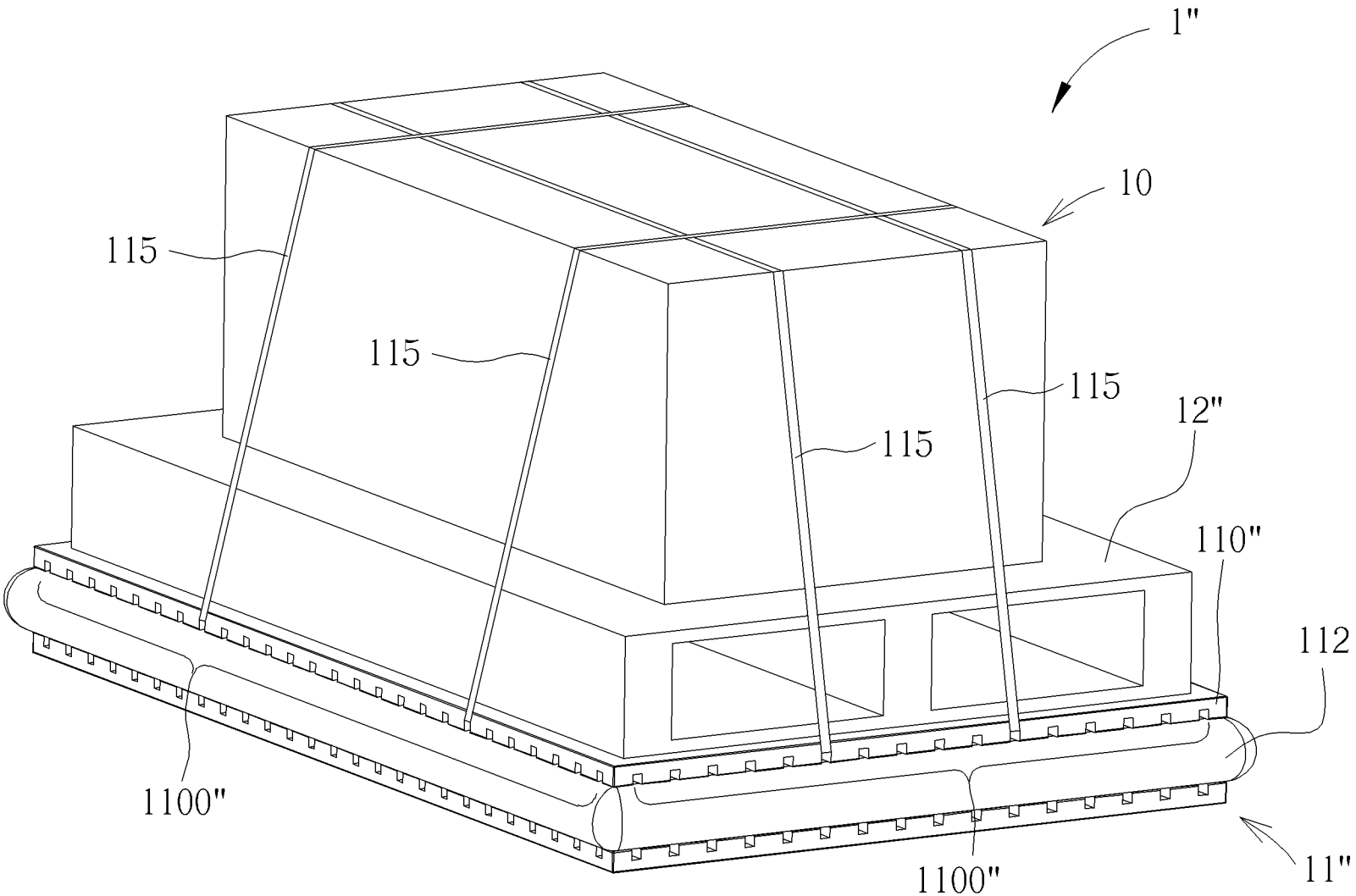
FIG. 10 is a partial schematic diagram of a cabinet device according to a third embodiment of the present disclosure.

Please refer to FIG. 10. FIG. 10 is a partial schematic diagram of a cabinet device 1" according to a third embodiment of the present disclosure. As shown in FIG. 10, the difference between the cabinet device 1" of the third embodiment and the cabinet devices 1, 1" of the aforementioned embodiments is described as follows. The cabinet device 1" includes the cabinet 10, a pallet structure 11" and a supporting plate 12". In this embodiment, the supporting plate 12" can be a wooden pallet. The cabinet 10 is horizontally placed on the supporting plate 12". The supporting plate 12" is disposed on the pallet structure 11". The pallet structure 11" includes a bottom plate 110", an air bag 112" and four packing straps 115 but does not include the aforementioned lateral plate and the aforementioned adjusting module. In this embodiment, the bottom plate 110" can be a steel plate, and the air bag 112" can be a single plate-shaped air bag sandwiched by the bottom plate 110". Forty two recesses 1100" are formed on the bottom plate 110". The four packing straps 115 wrap the cabinet 10 and pass through the corresponding recesses 1100", so as to fix the cabinet 10 onto the bottom plate 110" for restraining vertical movement and horizontal movement of the cabinet 10. However, the numbers and configurations of the recess 1100" and the packing strap 115 are not limited to this embodiment. It depends on practical demands.

In contrast to the prior art, the present disclosure utilizes the air bag for propping the cabinet upwardly until the supporting component leaves away from the supporting surface when the air bag is inflated. Therefore, the inflated air bag can absorb the shock load during transportation of the cabinet. On the other hand, when the air bag is deflated, the bottom plate can be driven to be lowered until the supporting component contacts the supporting surface. Therefore, the cabinet can be moved to the predetermined location by wheels easily. Therefore, the pallet structure of the present disclosure has advantages of simple structure and easy operation. Furthermore, all components of the pallet structure can be reused. For example, the air bag, which is used for absorbing the shock load, can be inflated and deflated repeatedly. It solves the problem of replacing shock-absorbing consumables, such as a conventional high density foam component, and reduces transportation cost.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A pallet structure capable of absorbing a shock load when transporting a cabinet, the pallet structure comprising:

at least one bottom plate for supporting the cabinet;

at least one air bag detachably installed on the at least one bottom plate, when the at least one air bag is inflated, the at least one air bag propping the at least one bottom plate against the cabinet upwardly to drive at least one supporting component of the cabinet to leave away from a supporting surface, and when the at least one air bag is deflated, the at least one bottom plate lowering the cabinet to drive the at least one supporting component to contact the supporting surface;

a plurality of lateral plates abutting against at least one lateral side of the cabinet; and a plurality of adjusting modules, each of the plurality of adjusting modules comprises two rods slidably disposed on the corresponding lateral plate and a connecting component slidably connected between the two rods disposed on the two adjacent lateral plates, the connecting component being located at a corner of the cabinet, and each of the lateral plates being located between two corresponding adjusting modules of the plurality of adjusting modules.

2. The pallet structure of claim 1, wherein the at least one air bag comprises a plurality of air bags and the pallet structure further comprises an inflating pipe assembly connected between the plurality of air bags and for inflating the plurality of air bags at the same time.

3. The pallet structure of claim 1, wherein each of the plurality of adjusting modules further comprises a plurality of fixing components, a sliding slot is formed on each of the plurality of rods, an adjusting slot is formed on each of two ends of each of the plurality of connecting components, at least one of the plurality of fixing components passes through the corresponding sliding slot to be fixed onto the corresponding lateral plate for restraining a relative movement between the corresponding rod and the corresponding lateral plate, and at least another one of the plurality of fixing components passes through the corresponding sliding slot and the corresponding adjusting slot to be fixed onto the corresponding connecting component for restraining a relative movement between the corresponding rod and the corresponding connecting component.

4. The pallet structure of claim 3, wherein each of the plurality of connecting components is substantially formed in an L-shape.

* * * * *